US005227809A

United States Patent [19]

Carpenter et al.

[11] Patent Number: 5,227,809

[45] Date of Patent: Jul. 13, 1993

[54] AUTOMATIC PRINT HEAD SPACING MECHANISM FOR INK JET PRINTER

[75] Inventors: Clayton W. Carpenter, Newberg; Arthur C. Van Horne, Lake Oswego; David W. Hanks; Donald B. MacLane, both of Portland, all of Oreg.

[73] Assignee: Tektronix, Inc., Wilsonville, Oreg.

[21] Appl. No.: 716,436

[22] Filed: Jun. 17, 1991

[51] Int. Cl.[5] ..... B41J 11/20

[52] U.S. Cl. ..... 346/1.1; 346/139 R; 400/56; 400/59

[58] Field of Search ..... 400/55, 56, 57, 59, 400/126; 346/139 R, 140 R, 134, 136, 1.1

[56] References Cited

U.S. PATENT DOCUMENTS

| | | | |
|---|---|---|---|
| 4,843,338 | 6/1989 | Rasmussen et al. | 346/140 R |
| 4,990,004 | 2/1991 | Kawahara et al. | 400/56 |
| 5,009,526 | 4/1991 | Kirchhof | 400/56 |

FOREIGN PATENT DOCUMENTS

| | | | |
|---|---|---|---|
| 0153682 | 9/1983 | Japan | 400/59 |
| 0211481 | 12/1983 | Japan | 400/59 |
| 0212372 | 10/1985 | Japan | 400/56 |

OTHER PUBLICATIONS

Rex, D. K., "Printhead Adjustment", IBM Tech. Discl. Bulletin, vol. 26, No. 12, May 1984, pp. 6373–6374.

"Self-Adjusting Forms Thickness Compensation for a Printer", IBM Tech. Discl. Bulletin, vol. 30, No. 8, Jan. 1988, pp. 406–407.

*Primary Examiner*—Benjamin R. Fuller
*Assistant Examiner*—Alrick Bobb
*Attorney, Agent, or Firm*—John D. Winkelman; Richard B. Preiss

[57] ABSTRACT

An ink jet printer (10) having a print head (14) for directing an ink jet toward a sheet of paper (16) includes automatic print head spacing apparatus (80) that holds the print head apart from the sheet of paper by a preselected distance. In a preferred embodiment, the printer includes a rotatable drum (20) for supporting the sheet of paper and media securing system (24) of a first predetermined thickness for securing the paper to the drum. The print head is positioned at the preselected distance after a major surface (130) of the print head engages and is pushed back by the media securing system.

19 Claims, 4 Drawing Sheets

AUTOMATIC PRINT HEAD SPACING MECHANISM FOR INK JET PRINTER

TECHNICAL FIELD

The present invention relates to ink jet computer printers and, in particular, to a mechanism for automatically providing a predetermined separation between an ink jet print head and a page on which an image is to be printed.

BACKGROUND OF THE INVENTION

Many computer printers, including some low resolution ink jet printers, scan a print head back and forth across a print medium (e.g., paper) to print graphics and text images thereon. Printing typically occurs while the print head is scanned in each direction, thereby employing relatively fast bidirectional printing.

An ink jet printer projects microscopic ink droplets from the print head onto the paper to form a printed image. Since the print head is typically not in contact with the paper, the droplets are projected to the paper through air. Accordingly, there is a propagation time during which the droplets propagate from the print head to the paper. This propagation time is dependent upon the velocity at which the droplets are ejected from the print head and the distance between the print head and the paper.

The print head is scanned across the paper at a scanning velocity. A droplet projected from the print head will have the scanning velocity in the direction the print head is being scanned. A droplet projected toward an image location on the paper must, therefore, be ejected from the print head at an ejection time that occurs before the print head is aligned with the image location. Nominally, the ejection time precedes the alignment of print head with the image location by about the propagation time of the droplet.

When printing takes place in only one scan direction, all droplets are subjected to the same scanning velocity. As a result, the alignment of droplets ejected during successive scans is substantially independent of the propagation time of the droplets.

In bidirectional printing, however, droplets are subjected to different scanning velocities during the successive scans in opposite directions. As a result, the alignment of droplets ejected during successive scans is dependent upon the propagation time of the droplets (i.e., the velocity at which the droplets are ejected from the print head and the distance between the print head and the paper).

The velocity at which the droplets are ejected can be precisely controlled by the print head. Accordingly, the distance between the ink jet print head and the paper must be accurately maintained to provide adequate alignment of the droplets ejected during successive scans in opposite directions. In low speed, low resolution ink jet printers of the type presently available, the distance can be maintained automatically, for example, by a semi-rigid follower wheel that rolls across the paper with the print head as it is scanned. In some other printers, a manual adjustment cam of the type used on conventional typewriters allows a user to select the desired distance.

These conventional spacing mechanisms do not provide spacing to within a tolerance adequate for high resolution ink jet printers. Such printers can form images with about 120 dots/cm and require that the distance between the print head and paper be maintained at within a tolerance of about ±0.025 mm. Moreover, such printers are sometimes adapted to print onto media having a wide range of thicknesses.

SUMMARY OF THE INVENTION

An object of the present invention is, therefore, to provide a spacing mechanism that establishes a predetermined separation between a print medium and a print head of an ink jet printer.

Another object of this invention is to provide such a mechanism that provides the predetermined separation automatically.

A further object of this invention is to provide such a mechanism that maintains the predetermined separation to within a tolerance that is compatible with high resolution ink jet printers.

Still another object of this invention is to provide such a mechanism that is compatible with media having a wide range of thicknesses.

The present invention is a spacing mechanism that automatically provides a predetermined separation distance between a print medium (e.g., paper) and a print head of an ink jet printer. In a preferred embodiment, the printer includes a rotatable drum for supporting the paper and a paper securing apparatus of predetermined thickness for securing the paper to the drum. During a spacing calibration process, the paper securing apparatus is pressed against the print head to push it away from the paper by the predetermined separation distance. The spacing mechanism secures the print head at the predetermined separation distance to within a tolerance acceptable for high resolution ink jet printing.

The printer includes front and rear guide rails along which a carriage supporting the print head slidably moves across the paper, the front guide rail being positioned between the rear guide rail and the drum. The carriage has a fixed-length coupling to the front guide rail, and the spacing mechanism provides an extendable coupling that varies the distance between the rear guide rail and the carriage. Varying the length of the extendable coupling causes the carriage to pivot about the front guide rail and position the print head at the predetermined separation distance.

Additional objects and advantages of the present invention will be apparent from the detailed description of a preferred embodiment thereof, which proceeds with reference to the accompanying drawings.

DETAILED DESCRIPTION OF PREFERRED EMBODIMENT

Figure 1:
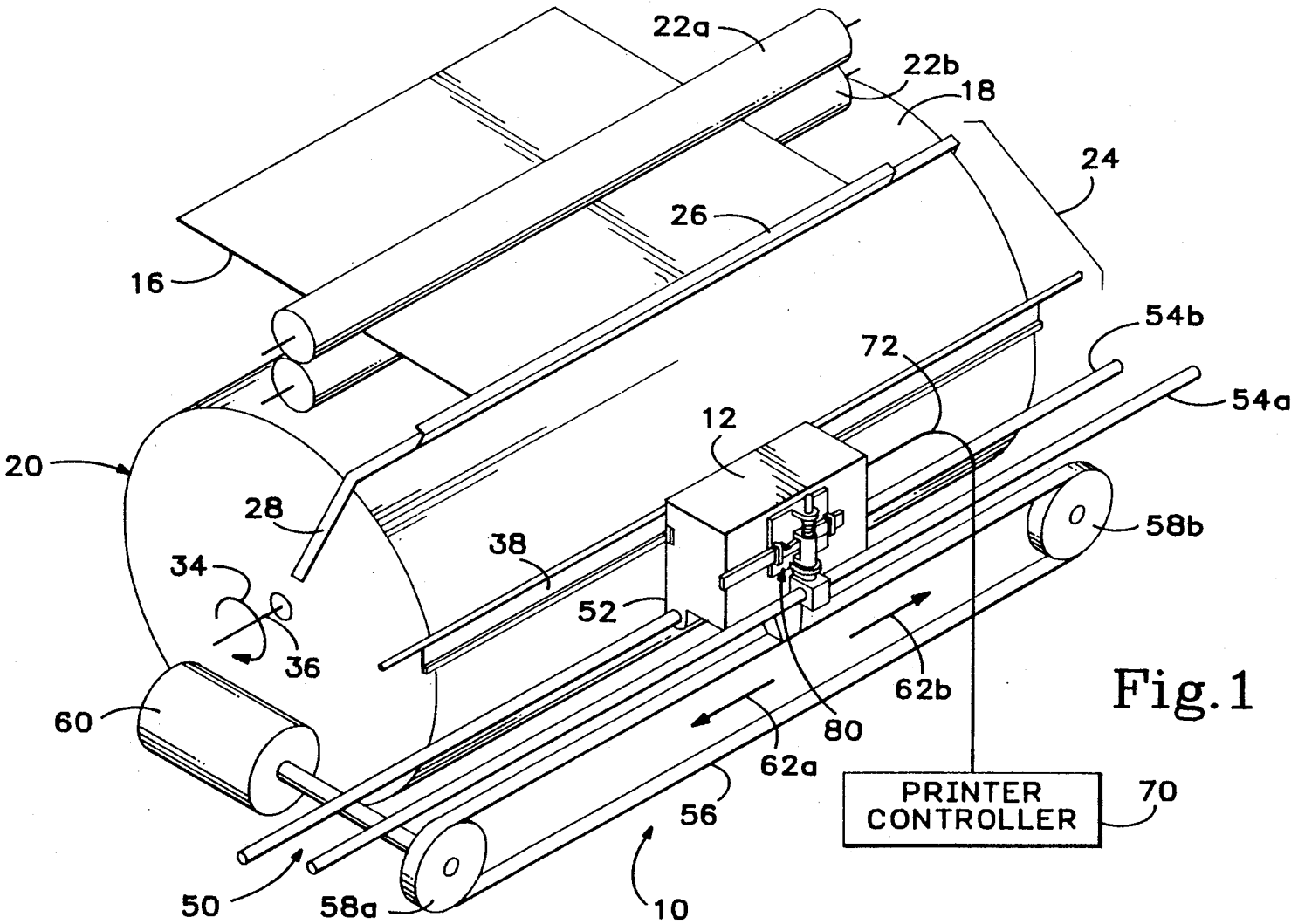
FIG. 1 is a simplified isometric view of an ink jet printer that includes an automatic print head spacing apparatus of the present invention.
Figure 4A:
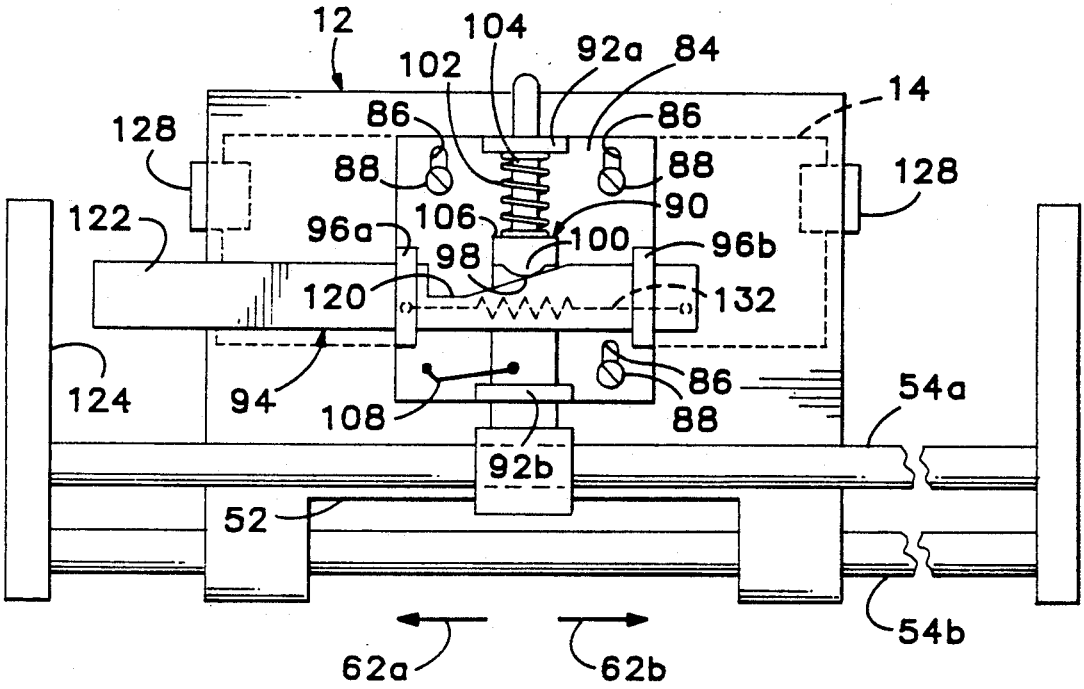
FIGS. 4A and 4B are respective front and side elevation views of a print head assembly and an associated print head spacing apparatus.
Figure 4B:
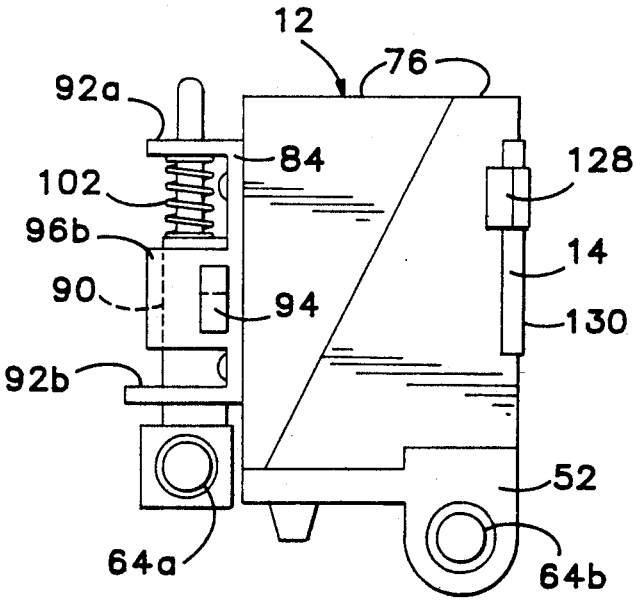

FIG. 1 shows a high resolution, full-color ink jet computer printer 10 having an ink jet print head assembly 12 that supports a print head 14 (FIG. 4B). Print head 14 preferably includes 96 orifices (not shown) from which ink droplets are ejected toward a print medium such as a sheet of paper 16. Printer 10 is capable of printing on a variety of print media including transparent films and labels. The following description refers specifically to paper 16 for purposes of simplicity.

Paper 16 is mounted on the outer surface 18 of a media support means or drum 20. Paper 16 is fed through a pair of media feed rollers 22*a* and 22*b* and secured to surface 18 by a media securing means or system 24. Securing system 24 includes a media clamp 26 that receives and clamps the side margin of a leading end of the sheet of paper 16 against drum 20. Media clamp 26 slides into and remains stationary within a slot 28 in drum 20.

Figures 5A, 5B, 5C:
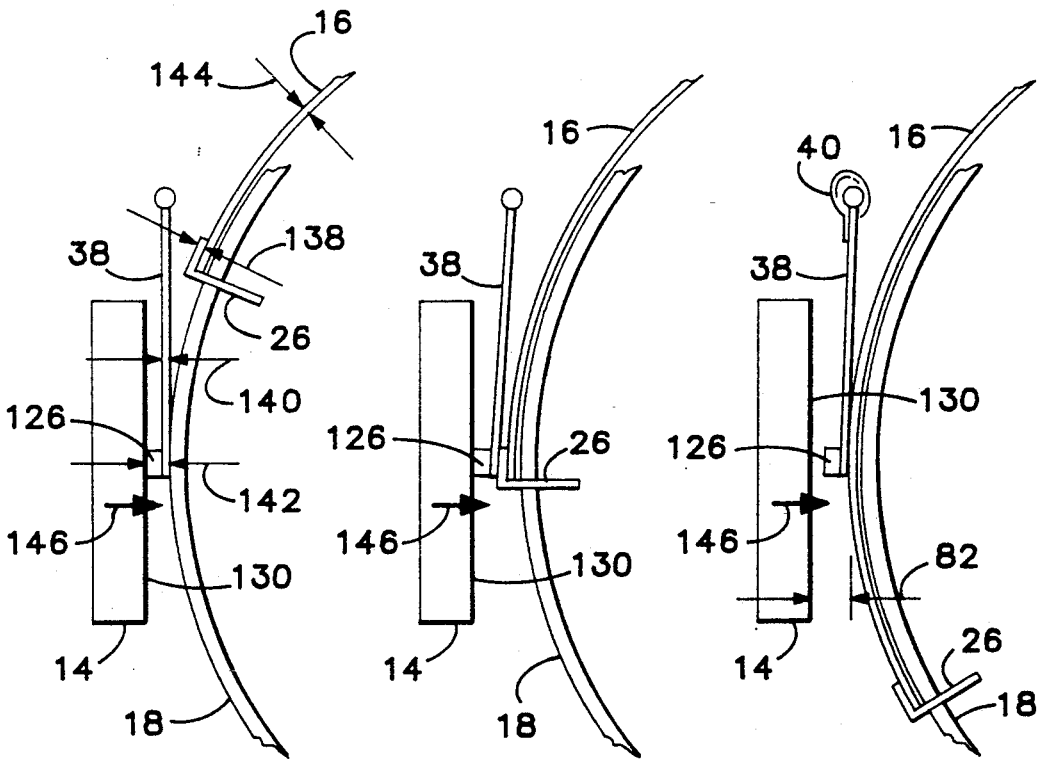
FIGS. 5A, 5B, and 5C are schematic side view diagrams showing the relationships between the print head and a print media support apparatus prior to, during, and immediately after a predetermined distance between them is automatically provided in accordance with the present invention.

A drum motor (not shown) slowly rotates drum 20 in a direction 34 about an axis 36 extending through the center and along the length of drum 20, thereby pulling the sheet of paper 16 through media feed rollers 22*a* and 22*b* and under a back tension blade 38 that is held under tension against surface 18 by a spring 40 (FIG. 5C). The sheet of paper 16 slides under and is held against surface 18 by back tension blade 38 as drum 20 rotates.

A print head positioning system 50 includes a carriage 52 slidably mounted on a pair of spaced apart, parallel guide rails 54*a* and 54*b* and supporting print head assembly 12. A carriage drive belt 56 is attached to carriage 52 and held under tension by a pair of spaced apart belt pulleys 58*a* and 58*b*. A carriage motor 60 linked to pulley 58*a* drives carriage 52 in directions 62*a* and 62*b* along guide rails 54*a* and 54*b*. Carriage 52 includes bushings 64*a* and 64*b* (FIG. 4B) that allow carriage 52 to slide smoothly along rails 54*a* and 54*b*.

While printing text or graphics images on the sheet of paper 16, the drum motor rotates drum 20 about axis 36 in incremental angular steps at about 1.5°/second. Simultaneously, carriage motor 60 drives carriage 52 along guide rails 54*a* and 54*b* at a speed of about 66 cm/second, and a printer controller 70 delivers print control signals to a control input 72 of print head 14.

In response to the print control signals, print head 14 ejects ink droplets directed toward the sheet of paper 16 supported on surface 18 of drum 20. The ink is preferably of a hot melt type that is contained in and heated by an ink supply chamber 74 and an ink reservoir 76 of print head assembly 12. The print control signals are delivered to print head 14 while carriage 52 is driven in both directions 62*a* and 62*b*, thereby providing boustrophedon or bidirectional printing in which successive image lines are printed alternately in directions 62*a* and 62*b*. Printer 10 is capable of forming a full-page, full-color image at a resolution of about 120 dots/cm in about 2 minutes.

Figure 2:
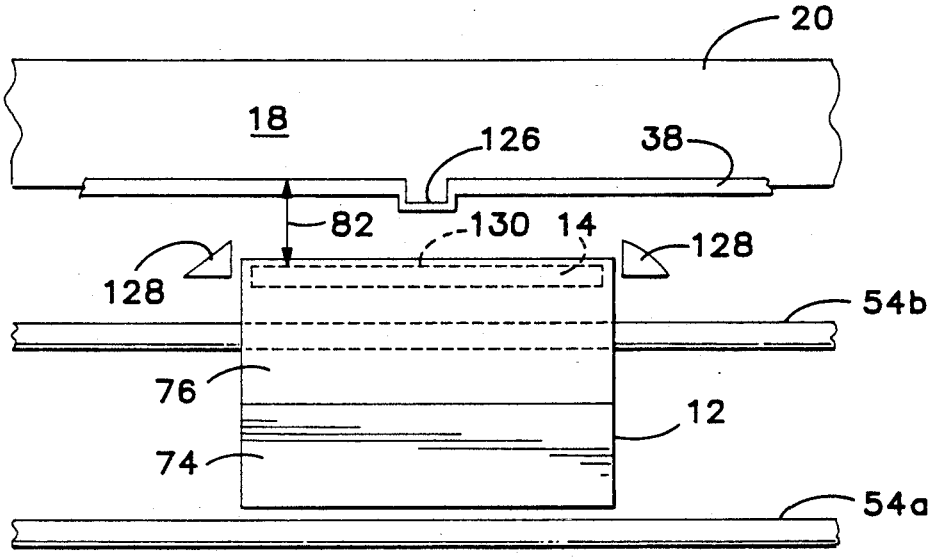
FIG. 2 is a enlarged, fragmentary plan view showing the print head assembly in the printer of FIG. 1.
Figure 3:
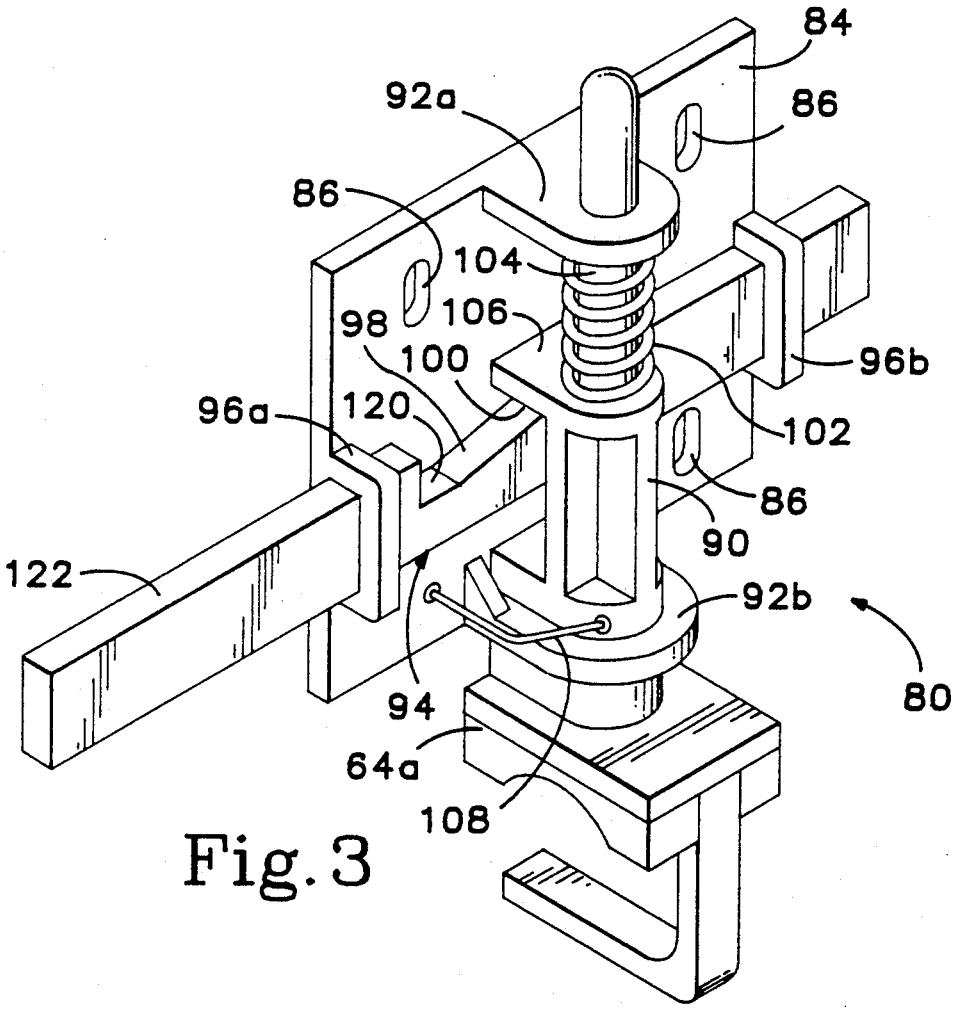
FIG. 3 is an enlarged, isometric view of an automatic print head spacing apparatus of the present invention.

With reference to FIGS. 1, 2, and 3, carriage 52 includes an automatic print head spacing apparatus 80 that provides a predetermined separation distance 82 between print head 14 and the sheet of paper 16. Separation distance 82 must be accurately maintained so that a droplet directed to an image location on a line formed during a scan in one direction will be properly aligned with an adjacent image location on the line formed during the next succeeding scan in the opposite direction.

At a resolution of 120 dots/cm, the nominal center-to-center spacing of droplets is 0.084 mm, and each droplet is positioned on the sheet of paper 16 within a tolerance of ±0.038 mm. To achieve such performance, spacing apparatus 80 automatically positions print head 14 such that separation distance 82 is 0.8 mm±0.025 mm.

Spacing apparatus 80 includes a mounting plate 84 with slotted apertures 86 through each of which a screw 88 extends to hold mounting plate 84 against ink supply chamber 74. A guide rail spacing element 90 supporting bushing 64*a* at one end is slidably secured to mounting plate 84 by a pair of parallel brackets 92*a* and 92*b*. An extension locking member 94 that is substantially perpendicular to spacing element 90 is slidably secured to mounting plate 84 by a pair of parallel, U-shaped brackets 96*a* and 96*b*.

Locking member 94 includes a ramp section 98 that is frictionally engaged by an arcuate slider 100 (FIG. 4A) of spacing element 90. Slider 100 is held against ramp section 98 under pressure by a coil spring 102 that encircles a stem 104 of spacing element 90 and extends between bracket 92*a* and a shelf 106 on spacing element 90. Spring 102 has a free length of 3.49 cm ±0.010 cm, and has a compression range of 1.24–1.94 cm over which respective forces of 1.5–1.66 lb±10% are exerted.

A torsion spring 108 extends between mounting plate 84 and spacing member 90 to prevent the latter from twisting about its length. Twisting of spacing member 90 interrupts the frictional contact between slider 100 and ramp section 98, thereby causing slippage between them. Torsion spring 108 exerts a torque of 0.31 cm–lb on spacing member 90.

Locking member 94 cooperates with spacing element 90 to space mounting plate 84 apart from guide rail 54*a* by varying distances. Spacing apparatus 80 functions, therefore, as an extendable coupling between guide rail 54*a* and print head assembly 12. Varying the length of the extendable coupling causes print head assembly 12 to pivot about guide rail 54*b* and change separation distance 82 between print head 14 paper 16. Preferably, the length of the extendable coupling is capable of varying by about 2 mm to provide a variation of about 1.25 mm in separation distance 82, thereby allowing printer 10 to accommodate paper 16 and other print media of thicknesses between 0.025 and 0.38 mm. The invention is not, however, limited to this range of media thicknesses.

With reference to FIG. 4A, slider 100 is reset to a low portion 120 of ramp section 96 immediately prior to securing a sheet of paper 16 to drum 20. This provides a maximum distance between print head assembly 12 and guide rail 54*a* and, therefore, a minimum separation between print head 14 and surface 18 of drum 20. Slider 100 is set to low portion 120 by moving carriage 52 in direction 62*a* so that an arm extension 122 of locking member 94 contacts a locking member stop 124 positioned at one side of printer 10. Carriage 52 continues in direction 62*a* until locking member 94 is slid across mounting plate 84 so that slider 100 reaches low portion 120.

With reference to FIG. 5A, print head 14 is positioned at the minimum distance from surface 18 of drum 20 after arm extension 122 resets slider 100 to low portion 120. Back tension blade 38 carries on its outer surface an embossed segment 126 that is spaced from print head 14 by about 0.13 mm, thereby allowing either of a pair of rigid print head safety ramps 128 to pass by embossed segment 126 without contacting it. Safety ramps 128 protect print head 14 from being damaged if print head assembly 12 inadvertently strikes an object as the assembly is scanned along guide rails 54*a* and 54*b*.

With reference to FIG. 5B, a sheet of paper 16 (shown separated from surface 18 for purposes of clarity) secured by media clamp 26 is rotated under back tension blade 38 so that embossed segment 126 engages or is pressed against a major surface 130 of print head 14. As a result, print head assembly 12 is pushed back toward guide rail 54*a* such that mounting plate 84 is forced downward along spacing member 90. Simultaneously, slider 100 is raised off of ramp section 98.

A spring 132 (shown in broken lines in FIG. 4A) extending from mounting plate 84 to the end of locking member 94 opposite arm extension 122 retracts when slider 100 is raised. Locking member 94 slides across mounting plate 84 until a higher portion of ramp section 98 reengages slider 100, thereby securing slider 100 in place. As a result, print head 14 is secured in place with a separation distance 82 established by the combined thicknesses of embossed segment 126 on back tension blade 38, media clamp 26, and the sheet of paper 16 or other print media. Spring 132 has a free length 4.35 cm±0.013 cm, and has an extension range of 6.6–8.6 cm over which respective forces of 15–25 gm±10% are exerted. FIG. 5C shows print head 14 spaced apart from paper 16 by separation distance 82 after media clamp 26 is rotated past back tension blade 38.

In the preferred embodiment, media clamp 26 and back tension blade 38 have respective thicknesses 138 and 140 of 0.30 mm, and embossed segment 126 has a thickness 142 of 0.20 mm. Printer 10 is capable of receiving paper 16 and other print media with a thickness 144 of between 0.025 and 0.38 mm. Accordingly, the predetermined separation distance 82 between print head 14 and paper 16 is the sum of thicknesses 138, 140, and 142, which is about 0.80 mm±0.025 mm.

To prevent it from damaging or misaligning print head 14, embossed segment 126 engages surface 130 of print head 14 at a preselected location at which there is a reduced possibility of damaging print head 14. The preselected location is above the positions of the print head orifices (indicated by arrow 146 in FIGS. 5A, 5B, and 5C) and behind which location there are no ink-carrying manifolds.

Moreover, the preselected location and embossed segment 126 are located at about the middle of the lengths of print head 14 and back tension blade 38, respectively. These locations minimize the variations in separation 82 caused by slight skewing of print head 14 on carriage 52 or by guide rails 54*a* and 54*b* not being parallel to axis 36 of drum 20.

It will be obvious to those having skill in the art that many changes may be made in the above-described details of the preferred embodiment of the present invention without departing from the underlying principles thereof. For example, an alternative to arm extension 122 and locking member stop 124 for resetting slider 100 could include a solenoid-controlled rotating cam held under tension by a spring. Moreover, an alternative to slider 100 and ramp section 98 for securing spacing member 90 in place could include a tensioned pivoting locking arm through which a spacing member could freely slide in only one direction. The scope of the invention should, therefore, be determined only by the following claims.

We claim:

1. An ink jet printer having a print head assembly with a print head for directing an ink jet toward an ink receiving medium, comprising:

media support means for supporting the ink receiving medium to receive the ink jet directed from the print head;

media securing means of a predetermined thickness for securing the ink receiving medium to the media support means; and print head spacing means coupled to the print head assembly for holding the print head apart from the ink receiving medium by a preselected distance after a major surface of the print head engages the media securing means.

2. An ink jet printer having a print head assembly with a print head for directing an ink jet toward an ink receiving medium, comprising:

media support means for supporting the ink receiving medium to receive the ink jet directed from the print head;

media securing means of a predetermined thickness for securing the ink receiving medium to the media support means;

print head spacing means coupled to the print head assembly for holding the print head apart from the ink receiving medium by a preselected distance after a surface of the print head assembly engages the media securing means; and first and second guide rails along which the print head assembly is slidably carried, the print head assembly having a fixed slidable coupling to the first guide rail and the print head spacing means including an extendable coupling of variable length between the second guide rail and the print head assembly for holding the print head apart from the ink receiving medium by the preselected distance, whereby varying the length of the extendable coupling causes the print head to pivot about the first guide rail and position the print head at the preselected distance.

3. The printer of claim 2 in which the first guide rail is positioned between the second guide rail and the media support means.

4. The printer of claim 2 in which the extendable coupling includes a mounting plate fixedly mounted to the print head assembly and slidably supporting a guide rail spacing member for spacing the mounting plate apart from the second guide rail by varying distances.

5. The printer of claim 4 in which the extendable coupling further includes an extension locking member that engages and holds in place the guide rail spacing member, thereby to hold the print head at the preselected distance.

6. The printer of claim 5 in which the guide rail spacing member is slidable in a first direction along the mounting plate and the extension locking member includes a cross arm supported by the mounting plate and in frictional engagement with the guide rail spacing member, the cross arm being slidable across the mounting plate in a direction transverse to the first direction.

7. The printer of claim 5 in which the guide rail spacing member is slidable in a first direction along the mounting plate and the extension locking member includes a cross arm supported by the mounting plate and having a ramp segment in frictional engagement with the guide rail spacing member, the cross arm being slidable across the mounting plate in a direction substantially perpendicular to the first direction.

8. An ink jet printer having a print head assembly with a print head for directing an ink jet toward an ink receiving medium, comprising:

media support means for supporting the ink receiving medium to receive the ink jet directed from the print head;

media securing means of a predetermined thickness for securing the ink receiving medium to the media support means, the media securing means comprising a media clamp for securing a leading edge of the ink receiving medium and a back tension blade that engages a major surface of the ink receiving medium; and print head spacing means coupled to the print head assembly for holding the print head apart from the ink receiving medium by a distance that equals a preselected thickness after a surface of the print head assembly engages the media securing means.

9. The printer of claim 8 in which the back tension blade includes a spacing element that engages the surface of the print head assembly.

10. In an ink jet printer having a print head assembly with a print head for directing an ink jet toward an ink receiving medium, the print head assembly being slidably carried along first and second guide rails and including a fixed slidable coupling to the first guide rail, the improvement comprising:

an extendable coupling of variable length between the second guide rail and the print head assembly for holding the print head apart from the ink receiving medium by a preselected distance, whereby varying the length of the extendable coupling causes the print head to pivot about the first guide rail and position the print head at the preselected distance.

11. The printer of claim 10 in which the extendable coupling includes a mounting plate fixedly mounted to the print head assembly and slidably supporting a guide rail spacing member for spacing the mounting plate apart from the second guide rail by varying, distances.

12. The printer of claim 11 in which the extendable coupling further includes an extension locking member that engages and holds in place the guide rail spacing member, thereby to hold the print head at the preselected distance.

13. The printer of claim 12 in which the guide rail spacing member is slidable in a first direction along the mounting plate and the extension locking member includes a cross arm supported by the mounting plate and in frictional engagement with the guide rail spacing member, the cross arm being slidable across the mounting plate a direction transverse to the first direction.

14. A print head assembly having a print head for directing an ink jet toward an ink receiving medium, the print head assembly being adapted for slidable movement along first and second guide rails of an ink jet printer and including a fixed slidable coupling to the first guide rail, comprising:

print head holding means for holding the print head apart from the ink receiving medium by a preselected distance, the print head holding means including a cross arm and a spacing element contacting each other and supported by a mounting plate for relative movement in transverse directions, the cross arm having a ramp segment that provides a contact surface for the spacing element to change a position of the spacing element in one of the transverse directions in accordance with a location of contact on the ramp segment, and the spacing element being operatively connected for pivotal movement about the second guide rail so that relative movement of the cross arm and the spacing element in transverse directions pivotally moves the print head about the first guide rail and positions the print head at the preselected distance.

15. The print head assembly of claim 14 further comprising urging means for holding the spacing element at the location of contact on the ramp segment of the cross arm.

16. The print head of claim 15 in which the urging means includes a first spring with different ends engaging the spacing element and the mounting plate to exert a force on the spacing element against the ramp segment of the cross arm.

17. The print head of claim 16 in which the spacing element includes a stem portion extending from a shelf portion, the mounting plate includes an apertured bracket, and a coil spring encircling the stem portion engages the apertured bracket and the shelf portion, thereby to exert the force on the spacing element against the ramp segment of the cross arm.

18. The print head of claim 15 in which the urging means includes first and second springs cooperating to force the spacing element and the ramp segment of the cross arm against each other so that application of an external force to the cross arm causes the relative movement of the spacing element and the ramp segment of the cross arm and removal of the external force ceases the relative movement and holds in place the spacing element and the cross arm.

19. In an ink jet printer having a movable print head for ejecting ink at a print medium having an undetermined thickness and being restrained by a holder, the print head and print medium being spaced apart by an adjustable head-to-print medium distance, a method for automatically setting a predetermined head-to-print medium distance independent of thickness of the print medium, comprising the steps of:

providing a head-to-print medium spacing adjustment that allows the head-to-print medium distance to increase freely but which prevents the head-to-print medium distance from decreasing except when reset to a minimum head-to-print medium distance;

resetting the head-to-print medium distance to a minimum distance between the head and the holder;

placing the print medium between the head and the holder;

interposing between the head and the print medium a device having a thickness equal to the predetermined head-to-print medium distance to thereby urge the head away from the print medium by the predetermined head-to-print medium distance; and removing the device from between the head and the print medium, whereby the head-to-print medium spacing adjustment prevents the head-to-print medium distance from decreasing and thereby holds the head-to-media spacing at the predetermined distance.

* * * * *